US007900883B2

(12) United States Patent
Portz

(10) Patent No.: US 7,900,883 B2
(45) Date of Patent: Mar. 8, 2011

(54) ITEM SECURING HOOK ASSEMBLY

(76) Inventor: Thomas J. Portz, Waukesha, WI (US)

( * ) Notice: Subject to any disclaimer, the term of this patent is extended or adjusted under 35 U.S.C. 154(b) by 0 days.

(21) Appl. No.: 12/171,722

(22) Filed: Jul. 11, 2008

(65) Prior Publication Data

US 2010/0006728 A1 Jan. 14, 2010

(51) Int. Cl.
*A47B 96/06* (2006.01)
*F16B 45/00* (2006.01)

(52) U.S. Cl. ..... 248/215; 248/304

(58) Field of Classification Search ..... 248/304–308, 248/303, 215

See application file for complete search history.

(56) References Cited

U.S. PATENT DOCUMENTS

| | | | | | |
|---|---|---|---|---|---|
| 224,003 | A | * | 2/1880 | Drew | 248/304 |
| 305,860 | A | | 9/1884 | Taylor | |
| 338,677 | A | * | 3/1886 | Rubenstien | 248/305 |
| 350,807 | A | | 10/1886 | Clark | |
| 424,239 | A | * | 3/1890 | Hackett et al. | 248/304 |
| 505,209 | A | | 9/1893 | White | |
| 750,634 | A | * | 1/1904 | Gable | 211/30 |
| 817,755 | A | * | 4/1906 | Doyle | 223/111 |
| 908,320 | A | | 12/1908 | Pagé | |
| 978,734 | A | * | 12/1910 | Gordon | 248/304 |
| 1,113,001 | A | * | 10/1914 | Goar | 248/306 |
| 1,714,087 | A | * | 5/1929 | Goldhardt | 211/8 |
| 1,912,950 | A | * | 6/1933 | Moungelis | 248/216.1 |
| D93,637 | S | | 10/1934 | Schirrmacher | |
| D99,440 | S | | 4/1936 | Levy | |
| 2,171,682 | A | * | 9/1939 | Byrnes | 70/59 |
| D126,709 | S | | 4/1941 | Warren | |
| 2,299,962 | A | * | 10/1942 | Byrkit | 248/305 |
| 2,583,563 | A | * | 1/1952 | Habel | 211/32 |
| 3,352,429 | A | * | 11/1967 | Magnuson | 248/304 |
| D296,759 | S | | 7/1988 | Greenhut et al. | |
| D307,539 | S | * | 5/1990 | Goodman et al. | D8/367 |
| D322,361 | S | | 12/1991 | Goodman et al. | |
| D343,066 | S | | 1/1994 | Hsu | |
| 5,984,250 | A | * | 11/1999 | Connor | 248/304 |
| D425,317 | S | | 5/2000 | Snell | |
| 6,152,419 | A | | 11/2000 | Bender | |
| D436,453 | S | | 1/2001 | Gastelum et al. | |
| 6,338,463 | B1 | * | 1/2002 | Babitz et al. | 248/317 |
| D456,695 | S | | 5/2002 | Goodman et al. | |
| D473,453 | S | | 4/2003 | Goodman et al. | |
| D491,791 | S | | 6/2004 | Snell | |
| D491,792 | S | | 6/2004 | Snell | |
| D496,257 | S | | 9/2004 | Fields | |
| D507,034 | S | | 7/2005 | Robertson | |
| D540,659 | S | | 4/2007 | Schmidt | |
| 7,201,355 | B1 | * | 4/2007 | Zien et al. | 248/301 |
| D544,067 | S | | 6/2007 | Wichem | |
| D544,220 | S | | 6/2007 | McConnell | |
| D551,481 | S | | 9/2007 | Loveless | |
| D555,754 | S | | 11/2007 | Wichem | |
| D556,292 | S | | 11/2007 | Shelton | |

(Continued)

*Primary Examiner* — Terrell Mckinnon
*Assistant Examiner* — Erin Smith
(74) *Attorney, Agent, or Firm* — Moore & Hansen, PLLP

(57) ABSTRACT

Units or hook assemblies arranged and configured to adequately capture and hold personal items which have some type of handle, rope, strap or the like. Preferred embodiments include a mounting plate for attachment to a restroom stall wall, door or the like. The mounting plate includes an upper end and a lower end. Preferred embodiments further include a first and second hook elements extending outwardly from the mounting plate. Preferred embodiments are arranged and configured to hinder theft or personal items stored on the hook from an over the stall door or wall attempt.

5 Claims, 6 Drawing Sheets

U.S. PATENT DOCUMENTS

| | | | |
|---|---|---|---|
| D557,120 | S | 12/2007 | Snell |
| D557,576 | S | 12/2007 | Crombie |
| D564,243 | S | 3/2008 | Zhang |
| D564,865 | S | 3/2008 | Johnson |
| D565,939 | S | 4/2008 | Newbould et al. |
| D567,517 | S | 4/2008 | Massaud |
| D568,621 | S | 5/2008 | Krumpe et al. |
| D573,357 | S | 7/2008 | Bickler et al. |
| D573,449 | S | 7/2008 | Goodman et al. |
| D574,224 | S | 8/2008 | Zhang |

* cited by examiner

ITEM SECURING HOOK ASSEMBLY

BACKGROUND

1. Field of the Invention

The present invention relates generally to a hook assembly or unit for attachment to a vertical surface. Particularly, the present invention relates to a unit attachable to a restroom stall wall or door for temporarily storing personal items such as hats, purses, backpacks, coats and the like. More particularly, the present invention relates to a restroom stall hook assembly that hinders theft of personal items stored in a receiving area of the hook assembly.

2. Description of the Related Art

There are a wide variety of hooks designed for hanging personal items such as hats, purses, backpacks, coats and the like. Many of these hooks are used in public restrooms, often secured to a stall surface such as the stall door or side wall. A visitor usually places their personal items on the hook while using the facilities to support the items off of the floor. A typical restroom hook includes a planar mounting element for attachment to the stall surface and one or two generally J-shaped hooks extending from the mounting element, either in horizontal or vertical alignment, for hanging the personal items.

Theft in public restrooms of personal items stored on restroom hooks while a person is in the stall is a prevalent problem. A significant amount of the problem stems from a simple theft in which an object, often a purse, is hung on an interior hook in a restroom stall. The thief reaches over the stall, pushes the item off of the hook and onto the stall floor while the owner is in a particularly vulnerable position. The item then drops to the ground and the thief can then reach under the stall and grab the fallen item. Before the owner of the item can react, the thief has fled. This method of theft is often referred to as "push, drop and grab".

Numerous attempts have been made to develop an anti-theft device for locking personal items to the device to prevent theft. These devices, such as those disclosed in U.S. Pat. Nos. 5,984,250 (Connor); 6,152,419 (Bender); 6,338,463 (Babitz et al.) and D551,418 (Loveless) are often large devices, many having numerous moving parts. Such devices are more expensive than traditional known hooks, can secure a very limited number and type of items and are somewhat difficult to use, particularly if a visitor is in a hurry or unfamiliar with that type of device.

The present invention addresses problems and limitations associated with the prior art.

SUMMARY OF THE INVENTION

The present invention is particularly useful in preventing such "push, drop and grab" theft. It is notable that features herein might suggest other uses and applications. Units or hook assemblies of the present invention adequately capture and hold personal items which have some type of handle, rope, strap or the like, such as a handbag, computer satchel or backpack. Various preferred embodiments of the present invention further are configured to simultaneously hold or rest a secondary item, for example, a coat.

Preferred embodiments of the present invention, because they have no moving parts, offer durability, cost effectiveness, and simplicity. One such preferred embodiment includes a mounting plate for attachment to a wall, door or the like. The mounting plate includes an upper end and a lower end. The mounting plate can be secured to a surface, such as a restroom stall door or wall, with screws, adhesive or the like.

The preferred embodiment further includes a first hook element having a first attachment end and a second distal end, the first hook element extending generally toward the upper end of the mounting plate and away from the mounting plate. In addition, the unit includes a securing member extending from the second end of the first hook element in the direction towards the mounting plate and a second hook element having an outer end, the second hook element positioned above the first hook element and extending away from the mounting plate. The preferred hook is arranged and configured such that the securing member of the first hook element is in the same horizontal plane as the outer end of the second retaining member when the hook is operatively secured to the surface. This configuration provides for a hook requiring a generally "Z"-shaped or zigzag motion to remove articles from within a storage area of the hook, thus making "push, drop and grab" theft of an item operatively stored on the hook extraordinarily difficult.

Alternate preferred embodiments of the present invention also include a mounting plate having upper and lower ends. In preferred embodiments, the hook assembly includes a first hook element extending from the lower end of the mounting plate. The first hook element includes a first attachment end and a second distal end. The first attachment end is interconnected to the mounting plate and the second distal end preferably includes a securing member extending toward the mounting plate. In preferred embodiments, the securing member is generally perpendicular to the mounting plate such that articles stored in a receiving area of the hook assembly are easy to place on the hook element, yet difficult for thieves to remove from an over-the-stall attempt as the securing member would have to be quickly and blindly maneuvered by the thief. Additional embodiments can include an upper securing member extending from the upper end of the mounting plate. The upper securing member preferably includes a first member that extends over the lower hook element when the hook assembly is operatively secured to the vertical surface. The upper member further includes a second member that extends downwardly from the first member and below the lower hook element. Preferably, the second member further includes a crook that at least partially extends towards the mounting plate such that it is at least partially in the same horizontal plane as the lower hook element.

These and various other advantages and features of novelty which characterize the present invention are pointed out with particularity in the claims annexed hereto and forming a part hereof. However, for a better understanding of the invention, its advantages and objects obtained by its use, reference should be made to the drawings which form a further part hereof, and to the accompanying descriptive matter, in which there is illustrated and described preferred embodiments of the present invention.

BRIEF DESCRIPTION OF THE DRAWINGS

In the drawings, in which corresponding reference numerals and letters indicate corresponding parts of the various embodiments throughout the several views, and in which the various embodiments generally differ only in the manner described and/or shown, but otherwise include corresponding parts.

DETAILED DESCRIPTION OF THE PREFERRED EMBODIMENTS

Figures 1, 2:
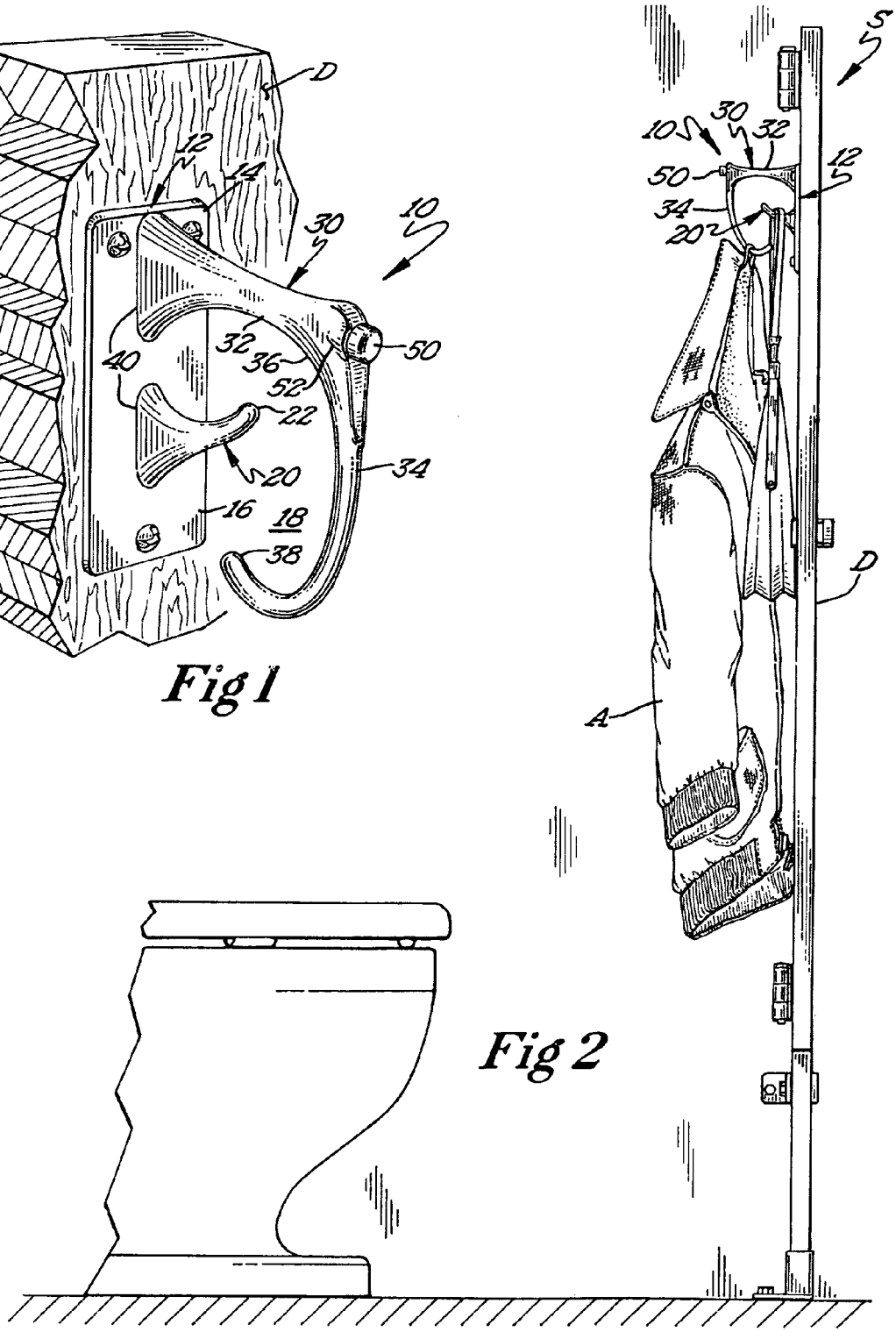
FIG. 1 is a perspective view of a hook assembly or unit 10 secured to a door D.
FIG. 2 is a side view of the hook assembly 10 of FIG. 1 secured to the door D of a restroom stall S, the hook assembly 10 having articles A hung therefrom.
Figure 3:
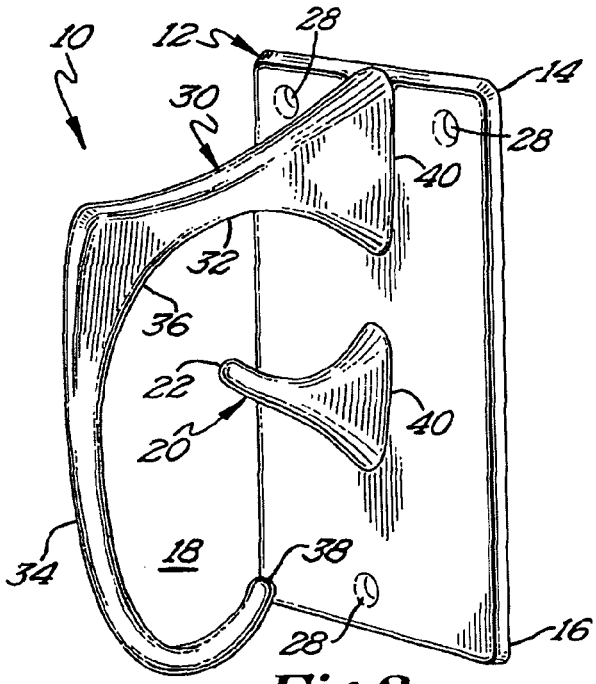
FIG. 3 is a perspective view of the hook assembly 10 of FIGS. 1-2.
Figure 4:
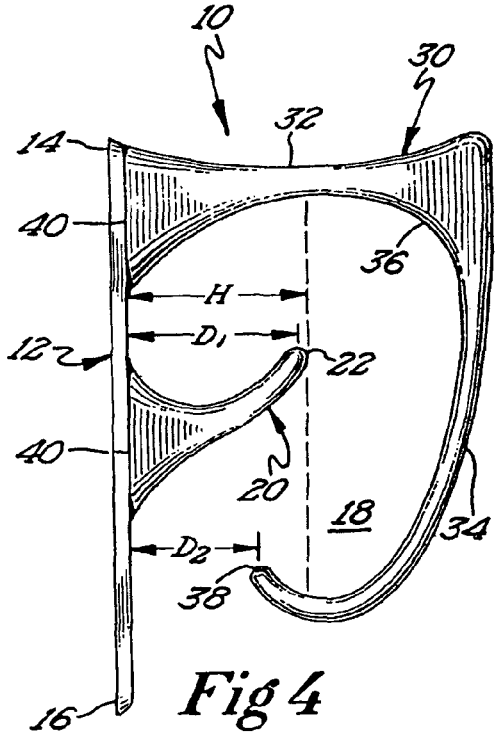
FIG. 4 is a side view of the hook assembly of FIGS. 1-2.

Illustrative embodiments are illustrated in FIGS. 1-12. One preferred embodiment of a hook assembly 10 or unit is illustrated in FIGS. 1-4. The illustrated unit or hook assembly 10 includes a mounting plate 12 arranged and configured for mounting on a vertical surface, such as a wall or restroom stall door D, the mounting plate 12 having an upper end 14 and a lower end 16. Extending from the mounting plate 12 is a lower hook element 20 having a lower crook 22 on which articles A can be hung. The preferred hook assembly 10 further includes an upper hook element 30 including a first member 32 extending outwardly and possibly upwardly from the mounting plate and a second member 34 extending downwardly from the first member 32. Preferably, the second member 34 extends below the lower hook element 20 such that articles A secured on the lower hook element 20 and within a receiving area 18 are thoroughly secured. In further preferred embodiments, the second member 34 includes an upper crook 38 that is positioned such that the second member 34 is at least partially located in the same horizontal plane H as the lower hook 20 element as illustrated. Such configuration requires a generally "Z"-shaped motion to successfully remove articles A hung on the lower crook 22. The upper hook element 30 preferably further assists in blocking any attempted contact with articles A hung on the upper or lower crooks 22, 38 from over the stall wall or door D. Preferred embodiments additionally include a reinforcing web 36 supporting the connection between the first and second members 32, 34. In addition, the upper and lower hook elements 20, 30 can include an increased thickness at their respective mounting plate connection joints 40 to increase the overall strength of the hook assembly 10.

Figure 5:
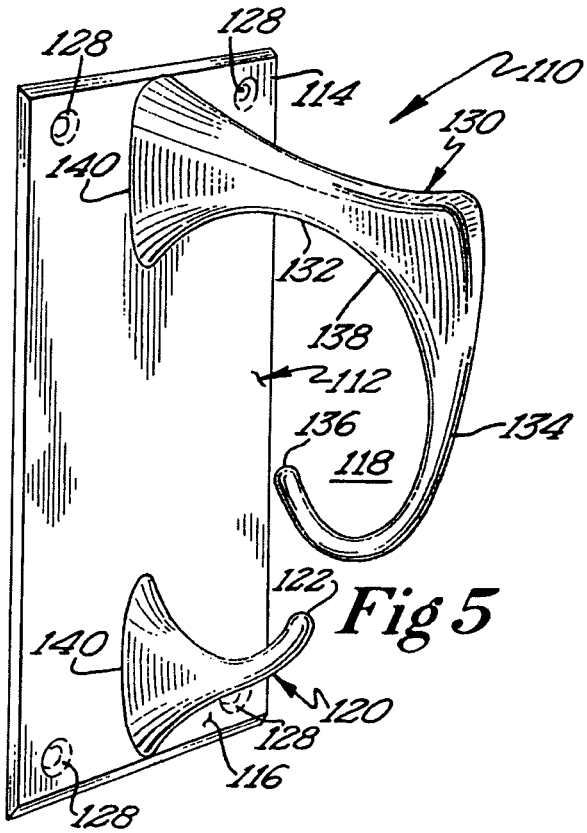
FIG. 5 is a perspective view of an alternate hook assembly or unit 110.
Figure 6:
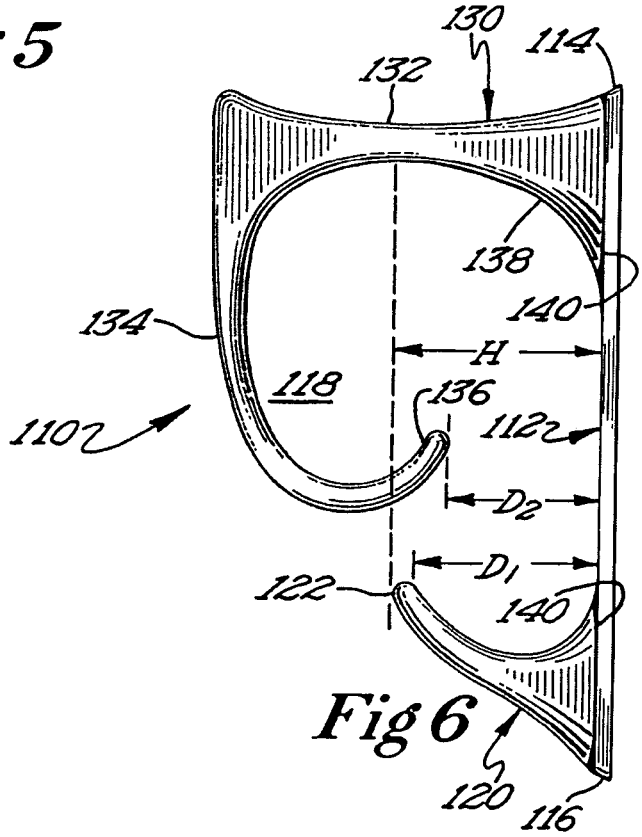
FIG. 6 is a side view of the hook assembly 110 of FIG. 5.

A similar hook assembly or unit 110 is illustrated in FIGS. 5-6. The illustrated unit or hook assembly 110 includes a mounting plate 112 arranged and configured for mounting on a vertical surface, the mounting plate 112 having an upper end 114 and a lower end 116. As with the previous embodiment, a lower hook element 120 extends from the mounting plate 112 and has a lower crook 122 on which articles can be hung. The preferred hook 110 further includes an upper hook element 130 including a first member 132 extending outwardly from the mounting plate 112 and a second member 130 extending downwardly from the first member 132. The second member 134 of this embodiment does not extend down past the lower hook element 120 as with the embodiment of FIGS. 1-4. The upper hook element 130 is preferably configured and arranged such that it assists in blocking any attempted contact with articles hung within a receiving area 118 on either the upper or lower crooks 120, 130 from over a stall wall or door. One arrangement to block any attempted contact with articles hung within a receiving area 118 is to configure the first member 132 to have a generally concave upper surface as illustrated.

As previously discussed, the second member 134 is located above the lower crook 122 when the unit 110 is operatively secured to a vertical surface. In further preferred embodiments, the second member 134 includes an upper crook 136 that is preferably positioned such that the upper crook 134 is at least partially located in the same horizontal plane H as the lower hook element 120 as illustrated.

Preferably, a first distance D1 between the lower crook 122 and the mounting plate 112 is greater than a second distance D2 between the upper crook 136 and the mounting plate 112. Such a configuration provides for better trapping of articles stored on the upper crook 136 as the lower crook 122 will likely catch any articles that are jostled off of the upper crook 136.

Preferred embodiments additionally include a reinforcing web 138 supporting the connection between the first and second members 132, 134. In addition, as with alternate embodiments, the upper and lower retaining members 120, 130 can include an increased thickness at their respective mounting plate connection joints 140 to increase the overall strength of the unit 110.

Figure 7:
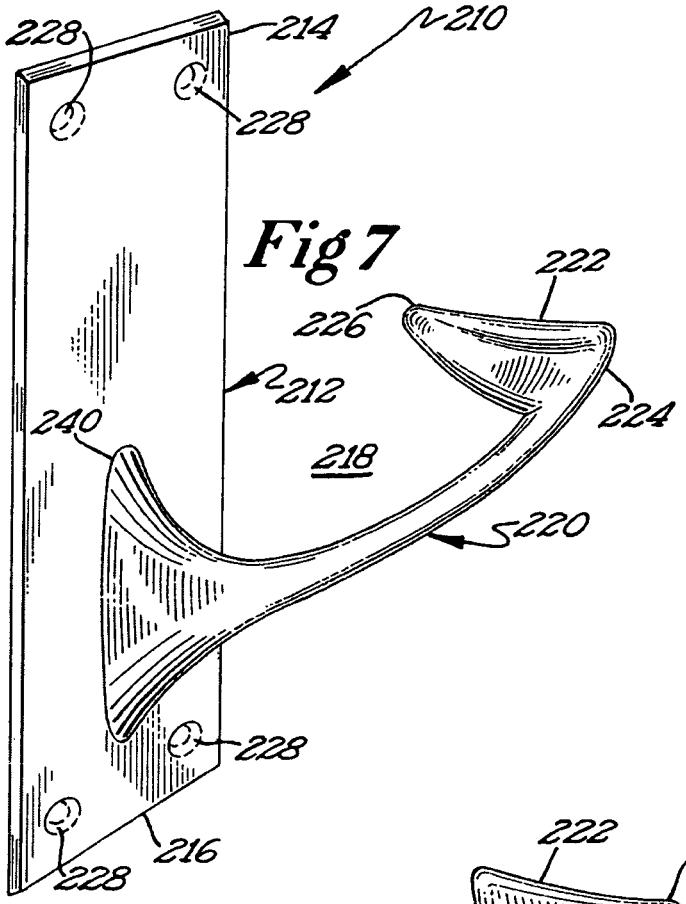
FIG. 7 is a perspective view of an alternate hook assembly or unit 210.
Figure 8:
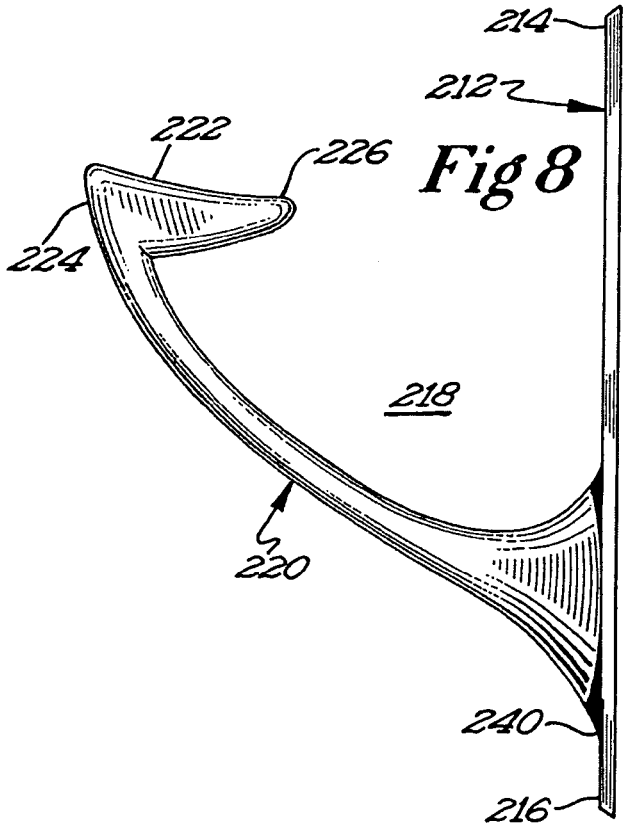
FIG. 8 is a side view of the hook assembly or unit of FIG. 7.
Figure 9:
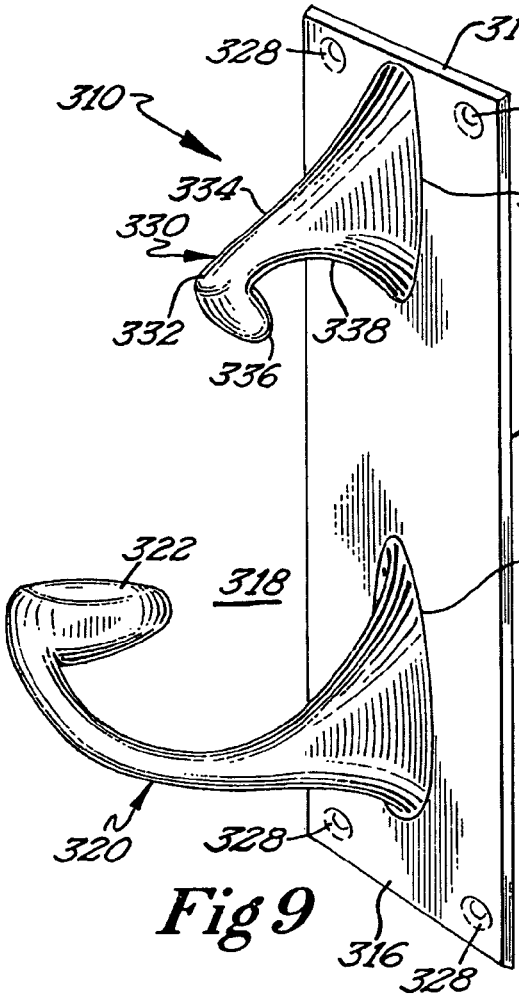
FIG. 9 is a perspective view of an alternate hook assembly or unit 310.
Figure 10:
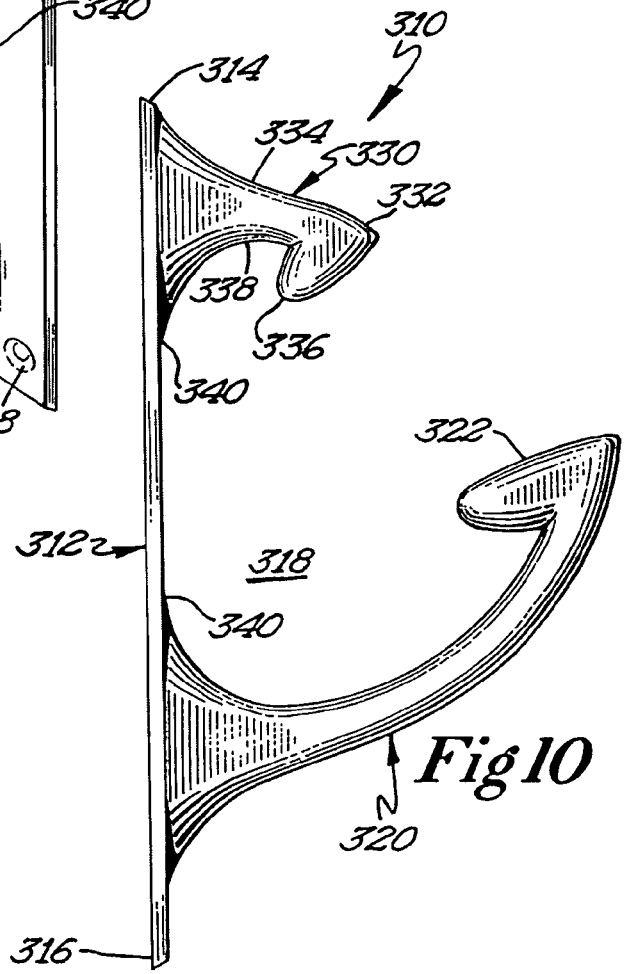
FIG. 10 is a side view of the hook assembly 310 of FIG. 9.
Figure 11:
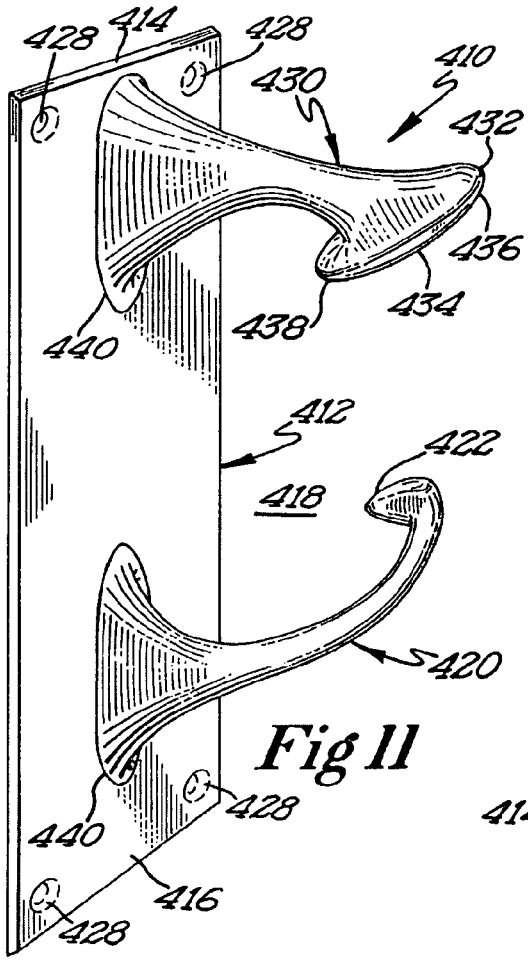
FIG. 11 is a perspective view of an alternate hook assembly or unit 410.
Figure 12:
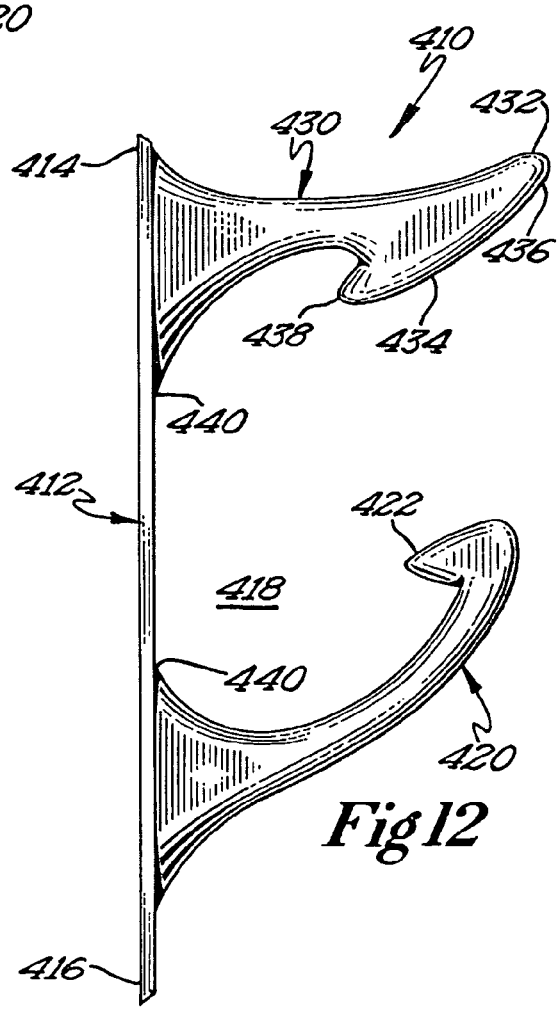
FIG. 12 is a side view of the hook assembly 410 of FIG. 11.

Yet another preferred hook assembly or unit is illustrated in FIGS. 7-8. This hook assembly or unit 210 similarly includes a mounting plate 212 arranged and configured for attachment to a vertical surface, the mounting plate 212 having upper and lower ends 214, 216. In preferred embodiments, the hook assembly 210 includes a lower hook element 220 extending from the lower end 214 of the mounting plate 212. The lower hook element 220 includes a first mounting end 222 and a second distal end 224. The first mounting end 222 is interconnected to the mounting plate 212 and the second distal end 224 includes a securing member 226 extending in the direction of the mounting plate 212. In preferred embodiments, the securing member 226 is generally perpendicular to the mounting plate 212 such that articles are easy to place within a receiving area 218 and on the first hook element 220, yet difficult for thieves to remove from an over-the-stall attempt. As with prior embodiments, the lower hook element 220 can include an increased thickness at its respective mounting plate connection joints 240 to increase the overall strength of the hook assembly 210.

The hook assemblies or units 310, 410 of FIGS. 9-12 include a mounting plate 312, 412 having upper 314, 414 and lower ends 316, 416 and a first hook element 320, 420 extending therefrom. The first hook element 320, 420 include a lower crook 322, 422 on which articles can be stored. The preferred hook assemblies 310, 410 further include a second securing member or second hook element 330, 430 extending outwardly from the mounting plate 312, 412 and over and above the lower crook 322, 422 of the first hook element 320, 420. The second hook element 330, 430 includes a distal end 332, 432. One preferred second securing member 330 is illustrated in Figs. C. In this embodiment, the second securing member 330 is generally linear and extends downwardly from the upper end of the mounting plate 312. Preferably, the distal end 332 is in the same horizontal plane H as the securing member 330 such that articles stored on the first hook element 320 cannot easily be pushed off of the first hook element 320 and out of a receiving area 318 from someone reaching over the stall (see also, FIG. 1).

Now also referring to Figs. D, this unit 410 has an alternate second hook element 430. As with the embodiment of Figs. C, this preferred second hook element 430 extends over the first hook element 420 and includes a distal end 432. The second hook element 430 provides an additional area to rest or hold an article. In this embodiment, the distal end 432 is generally "T"-shaped in cross-section. Preferably, the distal end 432 includes a guide surface 434 having a top end 436 and a bottom end 438, wherein the guide surface 434 is slanted such that the bottom end 438 is closest to the mounting plate 412. This arrangement is preferred such that articles will easily slide into a receiving area 418.

It will be understood that numerous sized and shaped mounting plates can be utilized in conjunction with the hook element(s) of the present invention. It will also be appreciated that the mounting plates of the present invention can be secured to the vertical surface with a variety of known techniques, such as, screws, adhesives or the like. The placement and number of any mounting apertures will vary depending on, for example, the attachment method chosen, the chosen material of the unit, the material of the vertical surface and the desired weight capacity of the unit.

When secured on the interior side of a restroom door, it is possible that the hooks of the present invention could strike the interior wall when the door swings open. If the hook is secured to the interior wall, it is possible that the door could strike the hook. These conditions can be mitigated by incorporating a conventional door stop. Alternatively, a bumper 50 can be incorporated into the hook or unit 10, 110, 210, 310, 410. A method of securing such a bumper 50 is to provide a protrusion 52 located on the unit, wherein an at least-partially elastic door stop having an aperture could be force fit onto the protrusion. The preferred bumper 50 is a relatively soft material, such as rubber, vinyl or the like.

The hook assemblies or units of the present invention can be manufactured in a variety of ways currently known in the art. One example is metal shaping. Many embodiments could be made by shaping a piece of metal into the mounting plate and lower hook element. For embodiments including an upper hook element, a secondary piece of metal could then be welded to the mounting plate to form the upper hook element. Following such a weld, some measure of grinding and/or polishing would be preferred. Mounting apertures, for example, mounting apertures 28, 128, 228, 328, 428, could then be drilled so that the respective hook assembly could be fastened to the mounting plate with screws. Alternatively, hook assemblies of the present invention could be made by casting. Following casting of the primary shape, some de-burring and polishing is preferred. As with metal shaping, mounting holes are then preferably drilled. An additional manufacturing method is forging. This method would produce a single, seamless object. Following forging of the primary shape, some measure of grinding, de-burring, and polishing could be desired. Mounting holes could then be additionally drilled as previously discussed. Moreover, it is envisioned that units of the present invention can be manufactured by extrusion or "draw" methods. In such cases, the profile of the unit would be drawn, cut, de-burred and then preferably polished and finished.

Hook assemblies or units of the present invention can be manufactured from a variety of known materials. These materials can include, but are not limited to, brass, stainless-steel, steel plated with zinc, chrome, brass, wrought iron, and plastic compounds. Certain compounds, such as polymers, are currently less practical for hook materials, but improved technologies could make various compounds, including polymers, a practical option. Manufacturing with such compounds could include, for example, molding or extrusion. Depending on the material chosen, it is possible that the following manufacturing of the shape of the hook assembly, a decision could be made to perform a secondary operation, such as heat-treating to improve characteristics of the hook assembly such as strength and durability as is known in the art.

Preferred hook assemblies of the present invention will not only hinder theft but will also be aesthetically pleasing. Therefore, preferred hook assemblies will additionally include a preference of color and finish. Each hook assembly of the present invention can be plated or painted as desired in accordance with known methods and means for the respective material of the unit.

The preferred hook assemblies of the present invention are minimally, if any, more expensive to produce than commonly used restroom stall hooks. Moreover, the preferred hook assemblies of the present invention can result in cost savings by preventing loss of the personal article, loss of any of the article's contents, time of the victim and property owner, time of law enforcement personnel and others involved, as well as preventing lost of time with possible insured claims and payments.

FIGS. 1-12 are not to scale. The preferred proportions and spacing will vary depending on the intended purpose of the hook or unit and manufacturer preference which may be based on, for example, consumer testing, market research and/or manufacturing considerations. Additionally, it will be understood that additional crooks or hook members can be incorporated into the teachings of this disclosure as desired. The disclosure is not intended to be limited to any specific number of crooks or hook members.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A unit for attachment to a vertical surface, the unit comprising:

a mounting plate having an upper end and a lower end;

a lower hook element having a distal end, the lower hook element extending outwardly from the mounting plate; and an upper hook element extending outwardly from the mounting plate, the upper hook element including a first member and a second member having a crook; wherein, when the unit is operatively secured to the vertical surface, the first member at least partially extends vertically above and horizontally beyond over the lower hook element and a second member extends downwardly from the first member and below the distal end of the lower hook element such that the crook is located below the lower hook element; wherein the upper hook element and the lower hook element are coplanar; wherein the second member includes a reinforcing web, the first member and the second member interconnected by the reinforcing web.

2. The unit of claim 1, wherein the lower hook element extending from the lower end of the mounting plate and the upper hook element extending from the upper end of the mounting plate.

3. The unit of claim 1, wherein the crook of the second member extending at least partially in the same vertical plane as the distal end of the lower hook element when the unit is operatively secured to the vertical surface.

4. The unit of claim 1, wherein the lower hook element includes a generally concave upper surface.

5. The unit of claim 1, wherein the distal end of the lower hook element includes a crook.

* * * * *